United States Patent [19]

Eddleman

[11] 4,130,473

[45] Dec. 19, 1978

[54] ELECTRODE STRUCTURE FOR USE IN METAL IN EXCHANGE APPARATUS USEFUL IN PURIFYING SPENT ACIDS AND THE LIKE

[76] Inventor: William L. Eddleman, 6638 Westchester, Houston, Tex. 77005

[21] Appl. No.: 810,494

[22] Filed: Jun. 27, 1977

Related U.S. Application Data

[63] Continuation-in-part of Ser. No. 664,240, Mar. 5, 1976, abandoned.

[51] Int. Cl.[2] ..... C25C 1/00; C25C 7/00; C25C 7/02; C25C 7/04

[52] U.S. Cl. ..... 204/252; 204/151; 204/260; 204/272; 204/282; 204/294; 204/296

[58] Field of Search ..... 204/151, 294, 295, 296, 204/301, 260, 263, 272, 252, 282

[56] References Cited

U.S. PATENT DOCUMENTS

| | | | |
|---|---|---|---|
| 3,389,200 | 6/1968 | Olstowski et al. | 204/294 X |
| 3,413,239 | 11/1968 | Olstowski et al. | 204/294 X |
| 3,507,773 | 4/1970 | Grangaard | 204/294 |
| 3,619,286 | 11/1971 | Gutnajer | 204/294 X |
| 3,694,281 | 9/1972 | Leduc | 204/296 X |
| 3,704,221 | 11/1972 | McCully | 204/295 |
| 3,859,195 | 1/1975 | Williams | 204/151 X |
| 3,915,822 | 10/1975 | Veltman | 204/151 |
| 3,984,303 | 10/1976 | Peters et al. | 204/260 |
| 4,040,938 | 8/1977 | Robertson | 204/260 X |

OTHER PUBLICATIONS

Indust. Engin. Chem. Prod. Res. Develop., vol. 13, No. 1, 1974, "Porous Plastics With Novel Properties Meet Variety of Design Needs", pp. 1–9.

*Primary Examiner*—Arthur C. Prescott
*Attorney, Agent, or Firm*—Donald Gunn

[57] ABSTRACT

An improved electrode is disclosed. The electrode is formed of an ion electrical permeable acid proof microporous sheet material which is impermeable to water molecules, the microporous material being supported mechanically on opposing faces by a nonwoven matted fiber body, the fiber body being impregnated with electrically conductive carbon in the form of graphite. The graphite is impregnated to an extent or depth to define within the opposing fiber bodies (separated by the microporous material) separate electrical terminals. Metallic contact terminals for connection in a DC electrical circuit are adhesively joined to the fiber bodies. Both fiber bodies can be made of one or two layers, one of which is graphite impregnated material.

9 Claims, 4 Drawing Figures

ELECTRODE STRUCTURE FOR USE IN METAL IN EXCHANGE APPARATUS USEFUL IN PURIFYING SPENT ACIDS AND THE LIKE

RELATED APPLICATIONS

This application is a continuation in part of application Ser. No. 664,240, filed Mar. 5, 1976 now abandoned.

BACKGROUND OF THE PROBLEM

A problem has been disclosed in previously filed applications (such as application Ser. No. 582,838) of this Applicant which problem is directed to the removal of metals in pickle liquors and the like. A pickle liquor is generally described as the acid bath used at a galvanizing plant or the like which acid when freshly charged has a pH of 1 and no metal therein and after use, the pH is raised perhaps slightly, and a noticable amount of metal in solution prevents its further use. Heretofore, the acid bath has been dumped. This creates a very difficult pollution problem. As disclosed heretofore, an apparatus has been provided which removes the metal content of the pickle liquor. This has utilized, in the main, a tank divided by an ion-permeable acid proof polypropylene diaphragm with an anode and cathode on opposite sides of the diaphragm. Typically, one of the electrodes has been formed of carbon and the other has been made of aluminum. The metals in the acid solution are deposited onto the cathode and are recovered.

This apparatus has proven quite successful. It is desirable to provide a pretreatment apparatus in accordance with the teachings of the present invention which is configured quite differently from the planar acid proof diaphragm, large plate electrodes and substantial tank disclosed in the copending application.

The apparatus of the present invention enables practically all of the free mineral acid to be recovered in pretreatment. Pretreatment apparatus contemplated by the present invention is easily constructed and moreover, is configured quite differently to enable it to be installed as an intermediate or pretreatment recovery apparatus in the process of purifying spent pickle liquor to enable its subsequent reuse.

This disclosure in particular avoids some of the mechanical limitations of the previous disclosures. They are directed to the planar membrane, parallel metal electrodes for metallic extraction and large tank which are so typical of permanent installations for large scale plants. The apparatus disclosed herein is intended to be used differently for extraction of free mineral acid ions and thereby lends flexibility to the plants of the previous disclosures. It permits a deviation in equipment geometry which is far more convenient to work with in some circumstances. Moreover, the equipment disclosed herein functions in the same manner and hence lends flexibility to the user of this equipment.

SUMMARY OF THE DISCLOSURE

This disclosure is directed to a multilayered apparatus to be used in the dialysis technique of free mineral acid removal from contaminated pickle liquor. The multilayered product utilizes an ionic permeable acid proof polypropylene microporous material which is about one mil thick. It is coated on both sides with a felt backing typically having a total thickness of about twenty to thirty mils. The felted, or nonwoven fibrous acid proof polypropylene material, is porous to enable ionic migration through the center diaphragm. Another acid proof nonwoven polypropylene backing on both sides is graphite impregnated to form conductive paths through the membrane. Suitable contact electrodes are attached to the two backings to enable connection of positive and negative terminals in a DC circuit to thereby create an anode and cathode in the felted members on opposite sides of the acid proof polypropylene diaphragm. The microporous material can be used in sheet form, or it can be coiled into a tube.

DESCRIPTION OF THE PREFERRED EMBODIMENT

Figure 1:
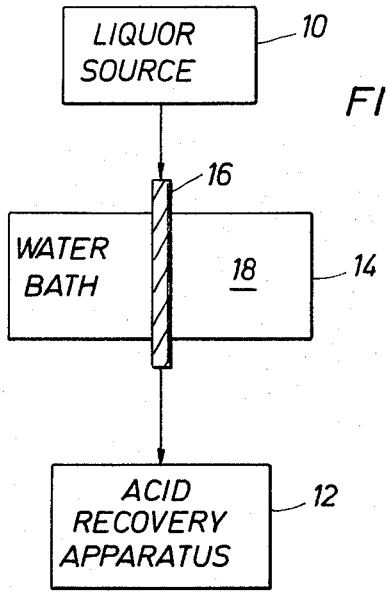
FIG. 1 is a flow chart showing the use of the improved electrode of the present invention in a spent liquor processing and recovery apparatus.

In FIG. 1 of the drawings, the numeral 10 identifies a pickle liquor source. For instance, it can be a galvanizing plant. It is typically in the form of several thousand gallons of sulfuric acid which initially has a pH of one. At the beginning, the acid is substantially pure but after it has been used for a period of time, it picks up a substantial content of metal, the particular metals being typically iron and many others in trace quantities. The acid of course is used until it is considered unusable by virtue of the excess metal content in it. The acid is then conveyed to a metal recovery apparatus 12 of the sort taught in the previously filed patent application Ser. No. 582,838. That disclosure clearly sets forth the manner in which the acid is treated and is recovered so that it is returned to the galvanizing plant, or other acid using facility, and it can be used and recycled indefinitely.

The numeral 14 identifies an apparatus in accordance with the teachings of this disclosure. Briefly, a specially made conduit 16 passing through a water bath 18 removes some or most of the acid content, and thereby enhances operation of the recovery equipment 12. As an example, the disclosed apparatus herein can be formed into a hollow pipe or tube. The spent acid which is heavily laden with metal ions is introduced into the tube which itself is submerged in a water bath. The tube itself is permeable to ions but not to water molecules. Rather, it is permeable to ionic movement across the diaphragm and thereby achieves an exchange through the diaphragm made of an acid proof polypropylene material. As described in greater detail in the above referenced disclosure, the metal ions migrate toward the cathode and the acid cations migrate toward the anode. This migration carries the anions and cations through a central diaphragm. The tube 16 incorporates that central diaphragm, only in tubular construction, and accordingly enables an exchange of ions through the wall of the tube 16. This will be more readily understood by reference to FIG. 2 of the drawings.

The numeral 20 identifies the composite multilayered apparatus of the present disclosure. It incorporates a central ion-permeable microporous diaphragm 22. The membrane 22 is made by the Celanese Corporation and is sold under the trademark "Celgard." It is typically about one mil thick. Other manufacturers of permeable microporous materials provide acceptable products. It is not necessary that it be any thicker. It has pores or openings in it which are sized to enable ions to pass through it but it does not ordinarily permit the passage of water molecules and the like. The Celgard product is quite thin and ordinarily requires structural reinforcement. For this reason, it has heretofore been attached to a felted material. In this disclosure, the felted material is identified by the numerals 24, 26, 32 and 34. Preferably, symetrical felt layers are attached on each face. The layers 24 and 26 are formed preferably of a non-woven fibrous mass of polypropylene fibers typically having a thickness of about 10 to 30 mils. It is normally not necessary to make it any thicker. It is porous, enabling migration of ions and molecules through the matted material. The matted or felted material supplies sufficient strength to structurally support the membrane 22 and the composite multi-layered apparatus shown in the drawings.

The felted material 24 and 26 thus defines two layers on opposite faces of the permeable diaphragm. The felted masses are impregnated with graphite. The graphite is finely ground to a particle size enabling the particles to embed in the felted material. A sufficient quantity of granular graphite is used to establish an electrical conductive path across the full surface of both felted members 24 and 26. The electrical path is not limited to any particular directional orientation. The graphite impregnation need only extend partly into the felted body. A nonimpregnated layer 32 and 34 is shown on each face of the diaphragm 22 and is made of the same felt material. An acid proof conductive adhesive is used to attach a small metal strip terminal 28 to the felted layer 24. A similar metal terminal 30 is attached to the other felted layer. The terminals 28 and 30 enable ohmic connection to conductors to connect the disclosed apparatus in a DC circuit. Preferably, they are attached by using electrically conductive adhesives. They can be in the form of thin foil strips to enable the multilayered apparatus to flex fold or bend.

Figure 2:
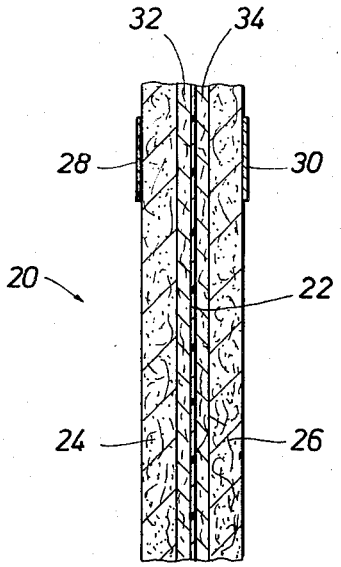
FIG. 2 is a sectional view, somewhat exaggerated in thickness, through the multi-layered apparatus of the present disclosure.
Figure 3:
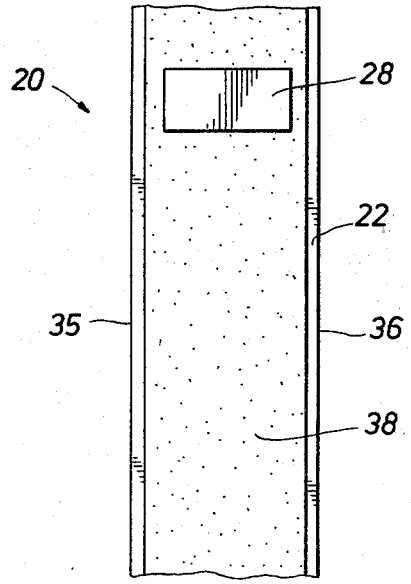
FIG. 3 is a plan view of the material of the present invention.
Figure 4:
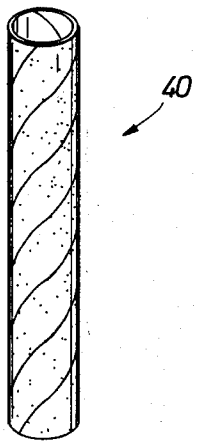
FIG. 4 shows the planar material formed into a hollow tube.

To avoid a short circuit, the thin plastic membrane 22 is somewhat larger than the felted layers 24 and 26. The felted layers 24 and 26 have the form of sheets which are affixed to it. The sheets are substantially unlimited in size except by practical factors such as ease of handling. Alternately, a short around the edge of the sheet is avoided by limiting the surface area that is graphite impregnated. For instance, the graphite impregnation may terminate a few millimeters from the edge of the felted bodies 24 and 26. This enables the diaphragm 22 to be supported by the felt layers 24 and 26 without fear of short circuiting around the edge of the diaphragm 22. This is better shown in FIG. 3 of the drawings where the numeral 36 identifies a marginal edge of the diaphragm 22. It preferably extends from the felted backing 38 by only a millimeter or so. This has use in forming a helical tube or winding 40. That is to say, sheet stock of the material disclosed in FIGS. 2 and 3 is formed into a hollow tube. The edges 35 and 36 are glued to one another. This locates one of the felt layers on the interior of the tube and the other on the exterior. This then locates one of the connective electrodes on the interior and the other on the exterior. This then constitutes the hollow tube 40 into a tubular diaphragm formed of an ionic permeable material (the product Celgard as previously mentioned) and as a consequence, isolation from the interior of the tube 40 to the exterior is achieved except that the ionic permeable diaphragm permits controlled migration therethrough as will be disclosed.

The tube 40 can have any length and diameter desired. The basic limitations on it are mechanical such as the requirements that it have a certain strength to enable it to withstand the wear and tear encountered in a typical installation. In other words, the tube 40 is substantially unlimited in theory but it is limited in dimensional layout only by practical factors. It is connected to a flow of the metal laden spent acid, and is submerged in a water bath, whereupon connection of the terminals 28 and 30 in a DC circuit cause ionic migration through the diaphragm 22.

Considering an example of application, assume that the positive terminal is on the exterior of the tube 40 while the negative terminal is on the interior. The tube 40 is placed in a water bath having a pH of about 7. A spent acid having a pH approximating one and heavily laden with metal ions, typically iron and other metals, is introduced into the tube as a liquid flow. The acid solution with metal ions flows through the tube 40. The current flow from the positive to the negative electrode is accomplished by ionic migration through the diaphragm. As a result of this, acid cations pass through the wall of the tube to the exterior into the water bath. Depending on the length of tube, the rate of flow, and other scale factors, a small or larger portion of the acid content in the pickle liquor is transferred into the water bath. The metal ions remain in the tube as a result of their affinity for the negative electrode.

Consider the tube 40 with the negative terminal on the exterior and the positive terminal on the interior of the tube 40. Consider the pickle liquor to flow through the tube 40 and the bath 18 to be water. The metal anions from the pickle liquor flowing through the tube migrate to the negative electrode on the exterior of the tube, thereby extracting metal anions from the pickle liquor. The acid cations remain in the tube, having an affinity for the negative electrode and flow out the end of the tube 40.

Consider the tube 40 with the electrical connections reversed. Consider the bath 18 to be pickle liquor, and consider water to flow through the tube 40. The negative terminal is placed on the exterior while the positive terminal is on the interior of the tube. This causes the sulfate cations to pass through the wall of the tube into the tube which removes the acid from the bath to drop the pH of the pickle liquor bath. The pickle liquor bath becomes less acidic and approaches a metallic salt solution while the flow through the tube becomes more acidic. Again, depending on scale factors, this can be continued to separate a fairly pure acid and metal salt solution. The metallic anion remains in the bath due to its affinity for the negative terminal on the exterior of the tube. This bath may be then subsequently processed by other techniques to remove the metal in solution as anions.

Consider the tube 40 with the positive terminal placed on the exterior while the negative terminal is on the interior. Consider the bath 18 to be pickle liquor and that water flows through the tube 40. Metal anions from the bath 18 flow through the tube to the negative terminal on the interior of the tube and are carried away with the water flow. The acid cation remains in the pickle liquor bath 18 due to the affinity of the cation for the positive electrode.

Thus the two liquids and the two electrodes can be reversed in position yielding four ways to practice the invention. The electrical power consumption is decreased (measured by kilowatt hours of power per pound of acid collected) by adding a small quantity of acid or salt to the water prior to initial operation. This increases current flow and reduces heating losses. The apparatus has been exemplified with sulphuric acid but it works quite well with other acids such as hydrochloric acid.

The process creates small bubbles of hydrogen and oxygen at the respective electrodes. The bubbles inside the tube are swept along with the flow while those on the exterior rise to the surface. The bubbles congregate and collect into larger bubbles in the nonwoven layers and migrate through them upwardly. Bubble movement agitates the liquid in and near the nonwoven layers which assists in distributing the transferred ions away from the diaphragm.

The multilayered material of the present disclosure can thus be formed into almost any shape. It is pliable and flexible and therefore lends itself easily to configuration. Moreover, it can be constructed into a shape through the use of acid proof adhesives.

The nonwoven material is made of one or two separate layers. The graphite impregnation into the material can be controlled in depth; accordingly, one layer will suffice. It is not essential that the graphite impregnated felt layer be spaced from the permeable acid proof polypropylene microporous material. It is helpful that the electrode action be spaced a few mils (5 to 20 mils in the preferred embodiment) to dilute the ion movement. This avoids excessive ion movement at discontinuities of the graphite electrode which excessive ion movements might damage the diaphragm. This also distributes the ions and bubbles in the solution, thereby cleaning the pores of the nonwoven electrodes.

The foregoing is directed to the preferred embodiment but the scope thereof is determined by the claims which follow.

I claim:

1. An apparatus for use in electrically separating metal ions and acid cations in an aqueous solution, comprising:

a diaphragm which is:

(a) cation and anion permeable;

(b) impermeable to water;

(c) provided with two sides and has a thickness of about one mil;

(d) acid resistant;

(e) a flexible sheet to enable rolling into a tube from sheet stock;

(f) has exposed sides accepting an adhesive at least sufficient to attach an electrode thereto;

two electrodes formed of a flexible matted fibrous body impregnated with an electrically conductive material, one of said electrodes attached to one side of said diaphragm and the other attached to the opposite side of said diaphragm; and means for connecting said electrodes in a DC circuit so that, on contact of said diaphragm with a solution of metal anions and acid cations, either the metal anions or acid cations move across said diaphragm dependent on current flow and the respective polarities of said electrodes.

2. The apparatus of claim 1 wherein said electrodes are formed of carbon impregnated nonwoven polypropylene fibrous material.

3. The apparatus of claim 1 wherein said connecting means comprises a metal foil conductive strip attached to said electrodes.

4. The apparatus of claim 1 wherein said diaphragm is in sheet form and said electrodes are in sheet form and are adhesively attached thereto with a margin of protruding diaphragm encircling said electrodes.

5. The apparatus of claim 1 wherein one of said electrodes is formed of two layers of nonwoven material, with one layer comprised of granular graphite impregnated therein to an extent to define an electrically conductive member.

6. The apparatus of claim 1 wherein said electrodes are about 10 to 30 mils thick.

7. The sheet material of claim 1 formed into a tube having one electrode on the exterior of the tube and one on the interior.

8. The apparatus of claim 1 wherein said connecting means comprises a metal foil conductive strip attached to said electrodes;

wherein said diaphragm is in sheet form and said electrodes are in sheet form and are adhesively attached thereto with a margin of protruding diaphragm encircling said electrodes; and wherein one of said electrodes is formed of two layers of flexible matted fibrous material and one layer comprised of granular graphite impregnated in flexible matted fibrous material in an amount to form an electrically conductive member; and said electrodes are about 10 to 30 mils thick; and one electrode is on the exterior of the tube, and one is on the interior.

9. The apparatus of claim 8 wherein said sheet material is spirally wound.

* * * * *